United States Patent [19]

Seragnoli

[11] 4,383,633

[45] May 17, 1983

[54] DEVIATOR DEVICE FOR WEBS, PARTICULARLY PAPER WEBS

[75] Inventor: Enzo Seragnoli, Bologna, Italy

[73] Assignee: G.D Societa' per Azioni, Bologna, Italy

[21] Appl. No.: 231,330

[22] Filed: Feb. 4, 1981

[30] Foreign Application Priority Data

Feb. 27, 1980 [IT] Italy ..... 3346 A/80

[51] Int. Cl.[3] ..... B65H 17/20

[52] U.S. Cl. ..... 226/194; 242/76

[58] Field of Search ..... 242/76, 75.3, 153, 154; 226/194, 196, 197, 199, 180, 3

[56] References Cited

U.S. PATENT DOCUMENTS

| | | | |
|---|---|---|---|
| 3,323,704 | 6/1967 | Hannis et al. | 226/180 |
| 3,776,442 | 12/1973 | Ridley | 226/198 |
| 3,912,143 | 10/1975 | Miller et al. | 226/3 |
| 4,011,814 | 3/1977 | Real | 101/288 |
| 4,212,422 | 7/1980 | Rauchfuss, Jr. et al. | 226/196 |

*Primary Examiner*—Leonard D. Christian

*Attorney, Agent, or Firm*—Merriam, Marshall & Bicknell

[57] ABSTRACT

Deviator device for a web, particularly a paper web, in which a deviator drum, disposed between an inlet guide surface and an outlet guide surface for the web, is variously inclined by rotation about an axis tangential both to the inlet surface and to the drum, in order to move the web transversely to the inlet surface through a required distance which can be varied at will within a required range.

5 Claims, 3 Drawing Figures

DEVIATOR DEVICE FOR WEBS, PARTICULARLY PAPER WEBS

BACKGROUND OF THE INVENTION

The present invention relates to a deviator device for webs, particularly paper webs.

In machines of any type which use continuous webs of paper or other like material, such as wrapping machines and packaging machines of any type, it is often necessary to transversely deviate a web in order to avoid some device on the machine, or in order to bring the web into perfect alignment with a web utilisation device disposed offset from the web.

In order to transversely deviate a web while keeping it parallel to itself, it is known to use a bar which can be variously inclined parallel to the feed plane of the web, and about which the web is wound in a spiral.

Such a known device, described for example in British Pat. No. 957,740, cannot be used if the web is particularly thin and delicate, and its feed speed exceeds a relatively low determined value.

In this respect, because of the friction forces which develop in contact with the deviator bar, the web tends to grip on to this latter, and if fragile is torn as soon as the speed becomes appreciable.

SUMMARY OF THE INVENTION

The object of the present invention is to provide a deviator device which is free from the aforesaid drawbacks and is of simple construction and easy use.

The said object is attained according to the present invention by a deviator device for webs, particularly paper webs and the like, comprising an inlet guide surface and an outlet guide surface for said web; a deviator drum mounted rotatable about a first axis and disposed between said inlet and outlet surfaces, said web winding in contact with part of the periphery of said drum when in use; and adjustable support means for varying the position of said first axis about a second axis perpendicular to the first and tangential both to said drum and to said inlet surface.

BRIEF DESCRIPTION OF THE DRAWINGS

Further characteristics and advantages of the present invention will be apparent from the description given hereinafter with reference to the accompanying drawings, which illustrate some non-limiting embodiments thereof, and in which.

DETAILED DESCRIPTION OF THE INVENTION

Figure 1:
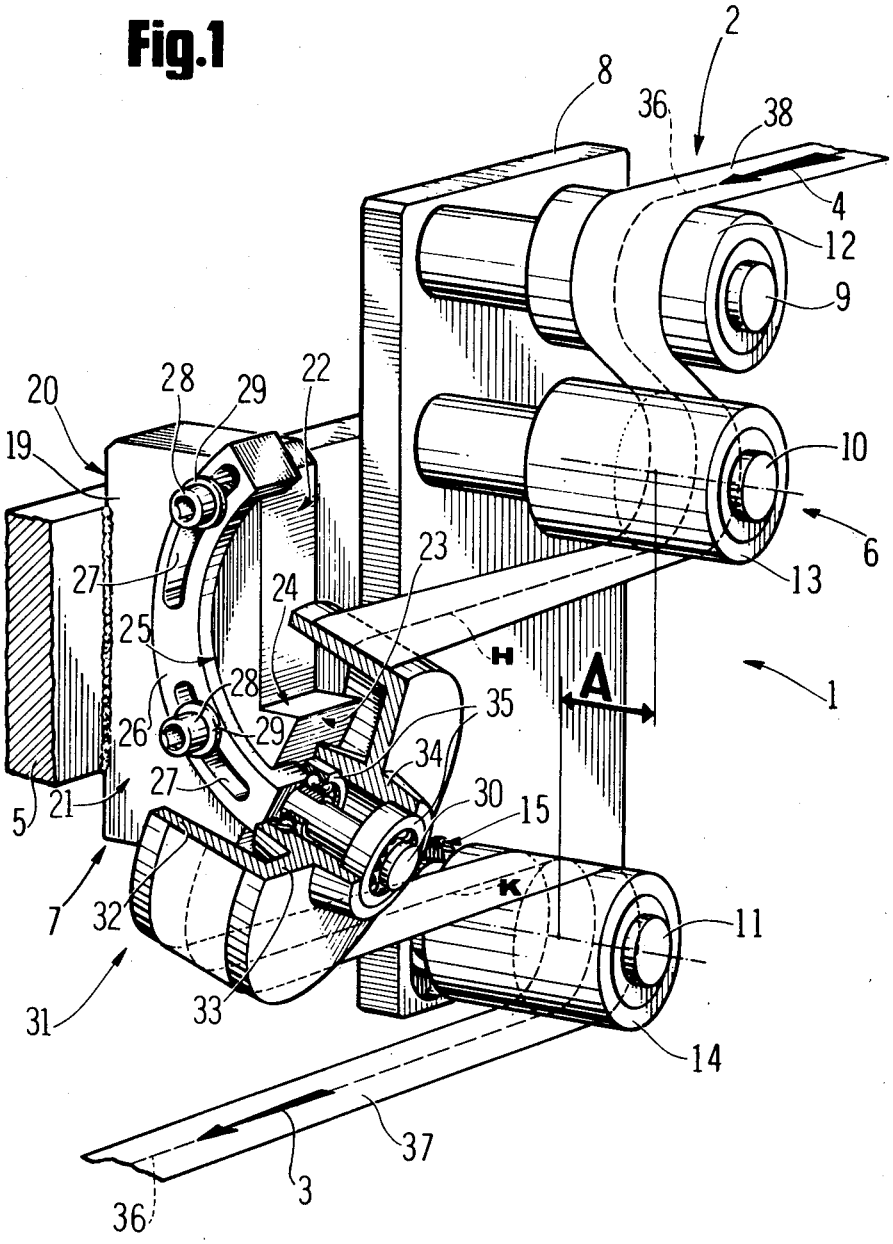
FIG. 1 is a partly sectional perspective view of a first embodiment of the deviator device according to the present invention.

FIG. 1 shows a deviator device indicated overall by 1, to which there is fed a continuous web 2, in particular a thin paper web, of which the outlet direction from the device 1, indicated in FIG. 1 by an arrow 3, is displaced transversely to the inlet direction of the web 2 in the device 1, indicated by an arrow 4 in FIG. 1, by a distance A which can be varied at will within a determined range.

The device 1 comprises a fixed support plate 5, to which a web guide unit indicated overall by 6 and a web deviation unit indicated overall by 7 are connected in positions facing each other.

The web guide unit 6 comprises a support plate 8 connected to the plate 5 by connection means, not shown. Preferably, but not necessarily, these connection means are of the detachable type and are arranged to enable the plate 8 to be positioned at will along a longitudinal axis of the plate 5.

Three pins 9, 10 and 11 extend from the plate 8 on the opposite side to the plate 5 and perpendicular thereto, they being preferably disposed in the same plane as in the example illustrated, and the first two being close together and disposed at a certain distance from the third, the pin 10 being disposed in a position between the pins 9 and 11.

Respective cylindrical rollers 12, 13 and 14 having a length greater than the width of the web 2 are rotatably mounted on the pins 9, 10 and 11 by way of bearings, not shown.

The pins 9 and 10 are mounted in a fixed position on the plate 8, and the pin 11 could also be connected in a fixed position on the plate 8, but is preferably mounted thereon by way of adjustment means in order to be able to traverse transversely to its own axis parallel to the plane of the pins 9 and 10.

Figure 2:
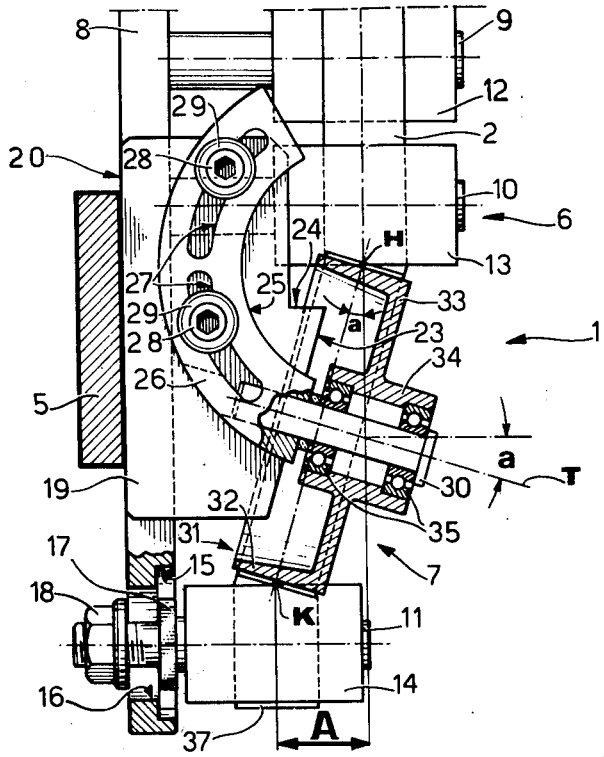
FIG. 2 is a partly sectional side elevation of the deviator device of FIG. 1.

For this purpose, as shown in particular in FIG. 2, the plate 8 comprises, on the side facing the roller 14, a groove 15 having its axis parallel to the plane of the pins 9 and 10 and in the base surface of which there is provided a through slot 16 traversed by the pin 11. This latter is provided with an elongated flange 17 which slidably engages the groove 15, and has a threaded end emerging from the slot 16 and engaged by a nut 18, by tightening which it is possible to lock the flange 17 in any position along the groove 15.

The web deviation unit 7 comprises a substantially parallelepiped block 19 welded to the plate 5 in a position adjacent to the plate 8, and having a rear surface 20 disposed in contact with the plate 5, a side surface 21 perpendicular to the plate 5 and parallel to the plane of the pins 9 and 10, and a front surface comprising a surface 22 parallel to the plate 5 and an inclined surface 23 connected together by a flat shoulder 24 perpendicular to the surfaces 21 and 22.

On the surface 21 there is provided a groove 25 in the form of a circular arc, its ends being open and disposed one at the other end of the surface 22 to the shoulder 24, and the other on the centre line of the surface 23.

A slide 26 in the form of a circular sector having a curvature identical to that of the groove 25 and with a length greater than that of this latter is slidably mounted in the groove 25.

The slide 26 has a substantially square cross-section, and is provided with two curved slots 27, through each of which there extends a respective screw 28 provided with a washer 29 and arranged to lock the slide 26 in the groove 25 in any required position.

One of the ends of the slide 26 extends outside the surface 23, and rigidly carries a pin 30, of which the axis T (FIG. 2) is substantially tangential to the longitudinal axis of the slide 26. The pin 30 rotatably supports a cylindrical drum indicated overall by 31 and comprising an outer cylindrical wall 32 provided at one end with an annular flange 33, which extends outwards from the centre line of a tubular hub 34 coaxial to the wall 32 and is rotatably coupled to the pin 30 by way of two bearings 35.

From FIG. 2, which is constructed by projecting the device 1 on to a plane parallel to the surface 21, it can be seen that the adjustable support means for said drum 31, i.e. the groove 25 and slide 26, have an axis of which the trace in the plane of FIG. 2 is indicated by H, this being perpendicular to the axis T and tangential both to the generating line of the roller 13 which faces the roller 14, and to a point on the centre of the generating line of the outer surface of the wall 32 facing the roller 13. This positional relationship is maintained whatever the position of the slide 26 along the groove 25, as the axis H is the axis about which the system constituted by the slide 26 and drum 31 rotates. When in operation, if a length of the axis 36 of the web 2 extending along a portion 37 of the web 2 leaving the device 1 is to be displaced transversely through a predetermined distance A with respect to a length of the axis 36 of the web 2 extending along a portion 38 of the web 2 entering the device 1, the slide 26 is positioned along the groove 25 such that the axis T of the drum 31 forms an angle a with a straight line parallel to the axes of the pins 9 and 10, so that:

$$A = D \sin a$$

where D is the diameter of the drum 31, i.e. the diameter of the outer surface of the wall 32.

The roller 14 is then displaced transversely until that generating line thereof facing the roller 13 is tangential to an axis K (FIG. 2) parallel to the axis H and tangential to a centre point on the generating line of the outer surface of the wall 32 facing the roller 14.

Finally, the web 2 is wound manually first about the roller 12 (in the anticlockwise direction in FIG. 1), then about the roller 13 (in the clockwise direction in FIG. 1), then about the drum 31 (in the anticlockwise direction in FIG. 1) and then about the roller 14 (in the clockwise direction in FIG. 1) in the direction indicated by the arrows 4 and 3.

The outlet portion 37 of the web 2 is then connected to a traction device (not shown), which when operated causes the web 2 to rapidly unwind through the device 1.

The position occupied by the web 2 and illustrated, in particular, in FIG. 1, in which the axis 36 of the web 2 extends along the axes H and K, is the most favourable in that it minimises the forces applied to the web 2 during its transverse movement. In this respect, in this position, the central zone of the lengths of web 2 extending between the drum 31 and the rollers 13 and 14 is subjected to pure torsion and to the traction imparted by the said traction device.

From the aforegoing, it is possible to use the device 1 even if extremely thin and delicate webs 2 are used.

As the position of the web 2 shown in FIGS. 1 and 2 is a position of "minimum force", i.e. a position of stable equilibrium, it also follows that the positioning of the web 2 about the rollers 12, 13 and 14 and the drum 31 does not require any particular care. In this respect, even if positioned in an incorrect manner, the web 2 becomes immediately disposed in the position illustrated in FIGS. 1 and 2 as soon as the traction device (not shown) is started, with the result that, when in use, the lateral displacement of the portion 37 relative to the portion 38 is always exactly equal to the required displacement A.

With regard to the roller 12, it should be noted that it is necessary only when the arrows 3 and 4 point in the same direction, whereas it can be dispensed with or otherwise not utilised if the arrows 3 and 4 point in opposite directions.

Figure 3:
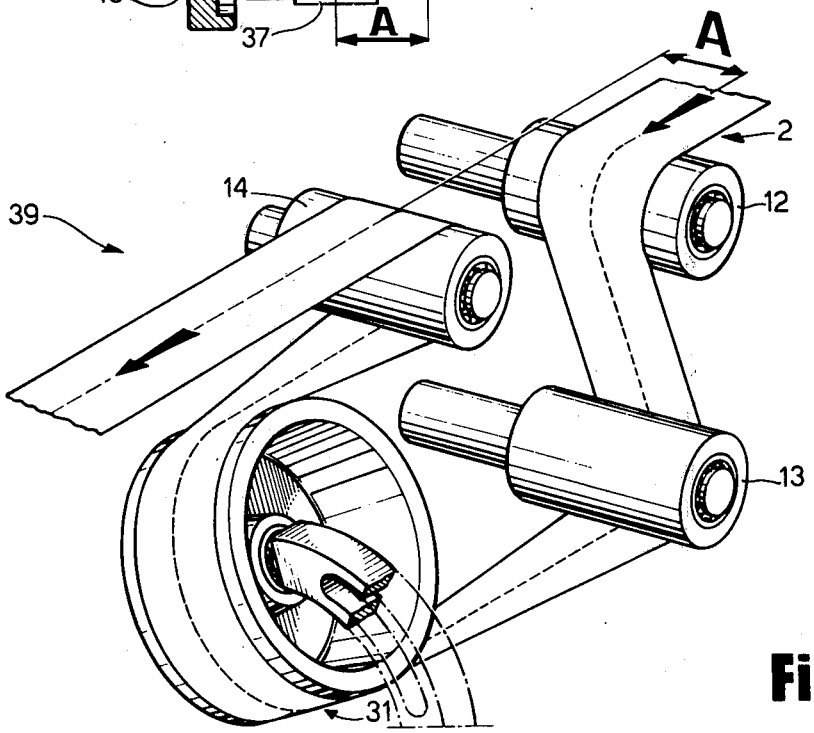
FIG. 3 is a diagrammatic perspective view of a second embodiment of the deviator device according to the present invention.

FIG. 3 shows a deviator device indicated overall by 39, the component parts of which are substantially identical to those of the device 1 and are indicated by the same reference numerals. The device 39 is also conceptually identical to the device 1, from which it differs only in that its roller 14 is disposed to the side of the rollers 12 and 13, and the drum 31 is disposed to the side of the rollers 12 and 13 and substantially aligned vertically with the roller 14. The different arrangement of the web 2 about the rollers 12, 13 and 14 and drum 31 can be perfectly deduced from the position of the web 2 shown in FIGS. 1 and 2, and does not require further explanation.

Within the principle of the invention, numerous modifications can be made to the described deviator devices without leaving the scope of the inventive idea.

In particular, the rollers 13 and 14 could be replaced by curved plates (not shown) arranged to define an inlet guide surface and an outlet guide surface in sliding cooperation with the web 2.

What we claim is:

1. A deviator device for webs, particularly paper webs and the like, comprising an inlet guide surface and an outlet guide surface for said web; a deviator drum mounted to rotate about a first axis and disposed between the inlet guide surface and the outlet guide surface, said web winding in contact with part of the periphery of said drum when in use; and adjustable support means for the drum for varying the position of said first axis about a second axis which is perpendicular to the first axis and tangential both to said drum surface and to said inlet surface.

2. A device as claimed in claim 1 in which the inlet guide surface and outlet guide surface are each defined by a respective roller mounted to rotate relative to a fixed support, with each roller disposed with its axis of rotation perpendicular to said second axis.

3. A device as claimed in claim 1 in which the adjustable support means for the drum comprises a slide of circular arc configuration, a guide support, and a guide of circular arc configuration, with a longitudinal axis, carried by the guide support so as to be in a position coaxial to said second axis; said guide having the same curvature as said slide and being slidably engaged by said slide, and with the first axis about which the drum rotates extending from an end of said slide in a position substantially tangential to the longitudinal axis of said guide.

4. A device as claimed in claim 3 having locking means for securing said slide relative to said guide in a required position.

5. A device as claimed in claim 1 including adjustment means for adjusting the position of said outlet surface in a direction perpendicular to said second axis.

* * * * *